United States Patent [19]

Bittar et al.

[11] 4,349,087

[45] Sep. 14, 1982

[54] ELEVATOR MOTOR/GENERATOR RUN PROTOCOL

[75] Inventors: Joseph Bittar, Simsbury; Frederick H. Nowak, Southington, both of Conn.

[73] Assignee: Otis Elevator Company, Farmington, Conn.

[21] Appl. No.: 234,079

[22] Filed: Feb. 13, 1981

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 2,968,364 | 1/1961 | Robertson | 187/29 |
| 3,506,095 | 4/1970 | Weaver | 187/29 |
| 3,658,156 | 4/1972 | Abbott | 187/29 |

*Primary Examiner*—J. V. Truhe
*Assistant Examiner*—W. E. Duncanson, Jr.
*Attorney, Agent, or Firm*—M. P. Williams

[57] ABSTRACT

A plurality of elevators operating under the control of a group controller may provide a start request to the group controller in response to service demand when their MG sets have not been commanded to run, and in the absence of a responsive MG start command from the group controller, can start their own MG sets if there has been a communication failure with the group, instantaneously if commanded to start on emergency power or after a time interval if not commanded to start on emergency power, the time interval for each elevator differing from that of the other elevators so as to avoid simultaneous start-up. The group controller can shut off all MG sets when there has been no service demand in any of the elevators for some period of time, but each elevator can also shut off its own MG set when it has had no service demand for a period of time which is longer than the period of time for which the group shutdown must wait. And, if the car is on service independent of the group, it can shut off its own MG set in less time than it would if it is on group service.

10 Claims, 4 Drawing Figures

ELEVATOR MOTOR/GENERATOR RUN PROTOCOL

DESCRIPTION

1. Technical Field

This invention relates to elevators, and more particularly to start-up and shutdown of elevator motor generator sets in joint response to a plural elevator group controller and individual elevator controls.

2. Background Art

The most popular form of electric elevators includes a DC motor which is powered by a motor generator (MG) set. The MG sets are typically operated at rated speed whenever they are necessary for use, but are shut down so as to save energy, wear and tear, and maintenance when they are not needed (such as at night in an office building). In multiple elevator systems there is usually provided a group controller which has as its principal function the allocation of hall calls to the various elevators, and the distributing of elevators for parking at various parts of the building when temporarily not in use. In prior art elevator systems having a group controller, the system is typically arranged so that if the group controller fails, the cars go onto a form of service which is variously referred to as "bus service" or "wild car service". In this type of service, each elevator is typically caused, by its own controls, to proceed to the lobby or other main landing, and to open its doors to receive passengers. Thereafter, each elevator will respond to any car calls made by passengers within the elevator, and will also automatically stop at floors designated just for that elevator to allow access to the elevator by any passengers on those selected floors, whether or not there are any passengers on the floors (thus the term "bus service").

In prior art plural elevator systems controlled by a group controller, the group controller will typically such down the MG set in all of the elevators if there has been no demand on any of the elevators for some predetermined time interval (on the order of a minute or so). Thereafter, if there is new demand for service, the group controller will successively start up each elevator in turn as the demand increases, frequently starting all elevators in the early morning, but starting only one or two elevators in the evening (for instance, in an office building). In the event that the group controller fails, the usual "wild car" or "bus service" form of operation requires that each of the elevators starts its own MG set. In prior art systems, this results in all of the MG sets accelerating from rest to near rated speed substantially simultaneously. This results in the need for an excessively large line power feeder to the group of elevators in order to handle the heavy currents required for the acceleration of the MG sets, all occurring simultaneously. Such high currents also have the present adverse effect of possibly causing the building power demands to exceed those permitted by a power company under a contract which provides penalty for exceeding certain, limited power demands.

In multigroup elevator systems controlled by a group controller known to the prior art, the MG sets of all of the elevators have been shut down (such as in the middle of the night in an office building) less than all of them need be started up, but whichever ones are started up will remain running until all that are running can be shut down once more. This means that any MG set which is running must remain running even though there isn't any need for that particular elevator to satisfy any demand while that elevator waits until all elevators are through satisfying demand in an ensuing time interval. The time interval is usually utilized so that elevators will not unnecessarily have their MG sets shut off during momentary lapses of service, but more likely recognize longer periods of service demand lapse. In many instances during the day, therefore, it is common that the MG sets of all of the elevators of a group will be running, even though only one or two elevators are actually satisfying all the demand, the remaining elevators being parked, doors closed, with their MG sets running. Although it might at first appear to be useful to allow each elevator to shut itself off when it has no demand, this can cause unnecessary power losses incurred by immediately having to reaccelerate the MG set, and can also cause delays in passenger service as a consequence of the too frequent necessity to wait for MG start-up before having an elevator available to satisfy demand.

DISCLOSURE OF INVENTION

Objects of the invention include provision of improvements in the starting of MG sets in multi-elevator systems, and the shutdown of MG sets in multiple elevator systems handled by a group controller.

According to a first aspect of the present invention, each elevator in a plural elevator system may provide an MG run command in response to service demand, the MG run command being provided after a time delay, the interval of the time delay in one car differing from that in another car by a time interval related to the time required to accelerate the MG set. According further to this aspect of the invention, each elevator may alternatively provide an MG run command in response to an order to start under emergency power. According still further to this aspect of the present invention, each of a plurality of elevators controlled by a group controller may provide an MG start request to the group controller in response to service demand, provide an MG run command in response to an MG start command provided to the car by the group controller, or provide an MG run command in the absence of the MG start command from the group controller if there is a failure of communication between the elevator and the group controller. In accordance further with this aspect of the invention, the MG run command is permitted to be generated immediately in response to a communication failure provided there is an emergency power start command as well; if there is no emergency start command, each elevator is permitted to start itself after a time interval which differs from the time interval of each other elevator by the time required to accelerate the MG set. In further accord with this aspect of the invention, a multi-elevator group controller provides only one MG start command to a single elevator during a given time interval, and then resets that command so as to be able to provide such a command to another elevator.

According to a second aspect of the present invention, each of a plurality of cars controlled by a group controller provides an indication to the group of whether or not the car has any service demand, and the lack of indicated service demand for any elevator in the group for a given period of time eliminates the MG run command in all of the elevators. In further accord with this aspect of the invention, if the group does not eliminate the MG run commands, each car can eliminate its own MG run command after an interval which is longer than the interval required for the group to eliminate the run commands. In still further accord with this aspect of the invention, if a car is on independent service, it can eliminate its own run command after a lesser time interval than when it is on group service.

The first aspect of the present invention eliminates the attempt on the part of more than one elevator to independently start its own MG set at any given time, provides interlocking between the group controller and all of the elevators with respect to the service demand at each elevator which can either respond to the group in starting in an orderly fashion, or starting itself if the group fails to do so. The invention provides immediate start-up in the case where an elevator is being started under emergency power, but provides time start-up in the case that an elevator is starting its own MG set other than in response to a command to start on emergency power.

The second aspect of the invention allows any elevator to shut down even though other elevators in the group are still satisfying demand, and allows itself to shut itself down more quickly if it is on independent service than if it is providing service under control of the group controller.

The invention permits more frequent shutting down of MG sets without diminishing passenger service and without increasing unnecessary start-ups and avoids excessive current drains which may occur if all of the elevators attempt to start up independently at the same time.

The present invention is readily implemented utilizing apparatus and techniques which are well known in the art in the light of the specific teachings relating thereto which follow hereinafter.

The foregoing and other objects, features and advantages of the present invention will become more apparent in the light of the following detailed description of exemplary embodiments thereof, as illustrated in the accompanying drawings.

BEST MODE FOR CARRYING OUT THE INVENTION

Figure 1:
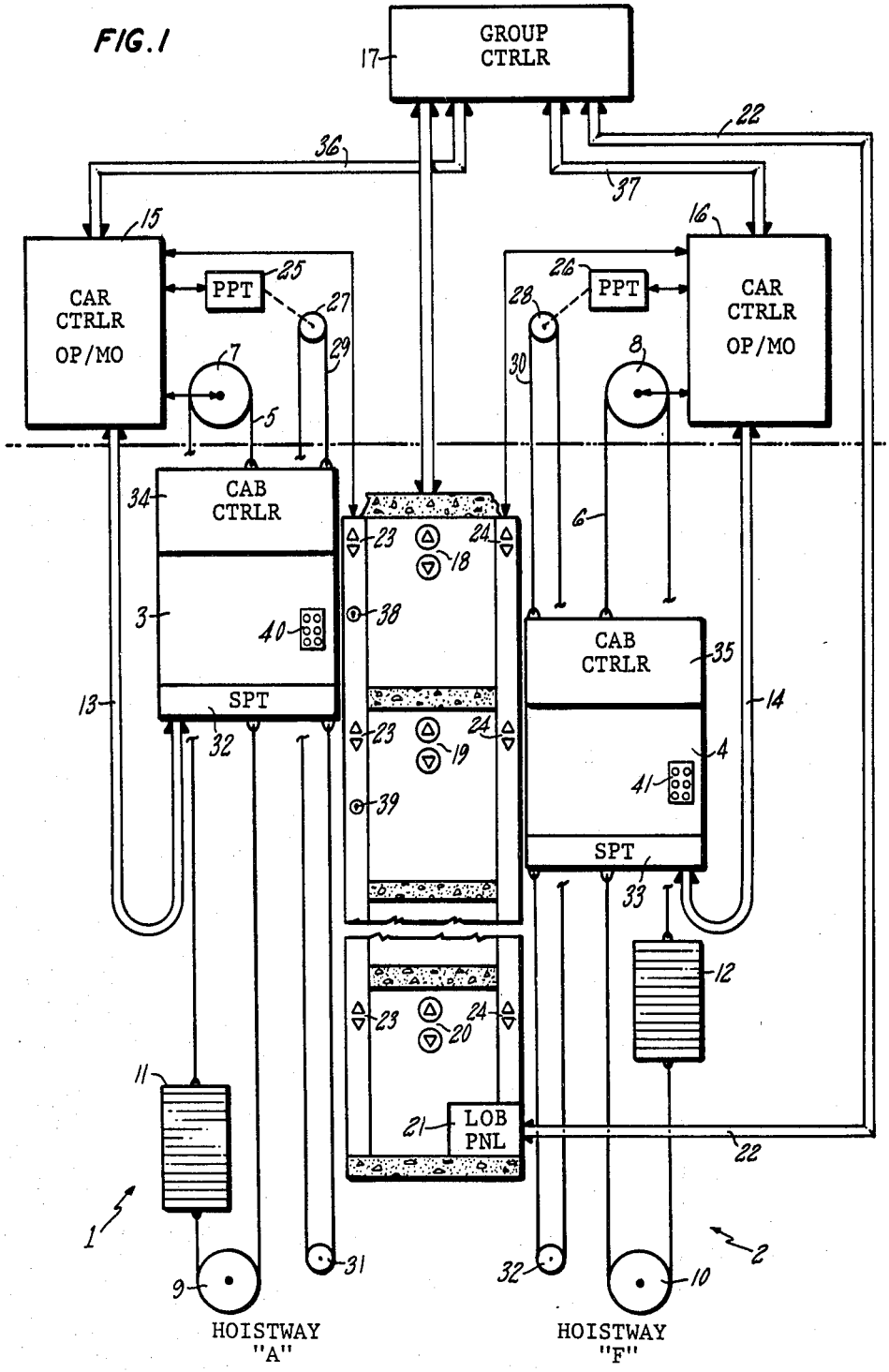
FIG. 1 is a simplified schematic diagram of a multi-elevator system operating under control of a group controller, in which the present invention may be practiced.

A simplified description of a multi-car elevator system, of the type in which the present invention may be practiced, is illustrated in FIG. 1. Therein, a plurality of hoistways, HOISTWAY "A" 1 and HOISTWAY "F" 2 are illustrated, the remainder are not shown for simplicity. In each hoistway, an elevator car or cab 3, 4 is guided for vertical movement on rails (not shown). Each car is suspended on a rope 5, 6 which usually comprises a plurality of steel cables, that is driven in either direction or held in a fixed position by a drive sheave/motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissible load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18–20 on the floors of the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasiabsolute, incremental encoder and counting and directional interface circuitry of the type described in a commonly owned copending U.S. patent application of Marvin Masel et al, Ser. No. 927,242, filed on July 21, 1978, (a continuation of Ser. No. 641,798, filed Dec. 18, 1975, now abandoned), entitled HIGH RESOLUTION AND WIDE RANGE SHAFT POSITION TRANSDUCER SYSTEMS. Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for verification of floor position information derived by the PPT 25, 26, may employ a secondary position transducer (SPT) 32, 33 of the type disclosed and claimed in a commonly owned copending U.S. application filed on Nov. 13, 1979, by Fairbrother, Ser. No. 093,475. Or, if desired, the elevator system in which the present invention is practiced may employ inner door zone and outer door zone hoistway switches of the type known in the art.

The foregoing description of FIG. 1 is intended to be very general in nature, and to encompass, although not shown, other system aspects such as shaftway safety switches and the like, which have not been shown herein for simplicity, since they are known in the art and not a part of the invention herein.

All of the functions of the cab itself may be directed, or communicated with, by means of a cab controller 34, 35 which may provide serial, time-multiplexed communications with the car controller as well as direct, hardwire communications with the car controller by means of the traveling cables 13, 14. The cab controller, for instance, will monitor the car call buttons, door open and door close buttons, and other buttons and switches within the car; it will control the lighting of buttons to indicate car calls, and will provide control over the floor indicator inside the car which designates the approaching floor.

The makeup of microcomputer systems, such as may be used in the implementation of the car controllers 15, 16, a group controller 17, and the cab controllers 33, 34, can be selected from readily available components or families thereof, in accordance with known technology as described in various commercial and technical publications. These include "An Introduction to Microcomputers, Volume II, Some Real Products" published in 1977 by Adam Osborne and Associates, Inc., Berkeley, Calf., U.S.A., and available from Sydex, Paris, France; Arrow International, Tokyo, Japan, L. A. Varah Ltd., Vancouver, Canada, and Taiwan Foreign Language Book Publishers Council, Taipei, Taiwan. And, "Digital Microcomputer Handbook", 1977–1978 Second Edition, published by Digital Equipment Corporation, Maynard, Mass., U.S.A. And, Simpson, W. E., Luecke, G., Cannon, D. L., and Clemens, D. H., "9900 Family Systems Design and Data Book," 1978, published by Texas Instruments, Inc., Houston, Tex., U.S.A. (U.S. Library of Congress Catalog No. 78-058005). Similarly, the manner of structuring the software for operation of such computers may take a variety of known forms, employing known principles which are set forth in a variety of publications. One basic fundamental treatise is "The Art of Computer Programming," in seven volumes, by the Addison-Wesley Publishing Company, Inc., Reading, Mass., and Menlo Park, Calif., U.S.A.; London, England; and Don Mills, Ontario, Canada (U.S. Library of Congress Catalog No. 67-26020). A more popular topical publication is "EDN Microprocessor Design Series" published in 1975 by Kahners Publishing Company (Electronic Design News), Boston, Mass., U.S.A. And a useful work is Peatman, J. B., "Microcomputer-Based Design" published in 1977 by McGraw Hill Book Company (worldwide), U.S. Library of Congress Catalog No. 76-29345.

The software structures for implementing the present invention, and peripheral features which may be disclosed herein, may be organized in a wide variety of fashions. However, utilizing the Texas Instruments' 9900 family, and suitable interface modules for working therewith, an elevator control system of the type illustrated in FIG. 1, with separate controllers for the cabs, the cars, and the group, has been implemented utilizing real time interrupts, in which power-on causes a highest priority interrupt which provides system initialization (above and beyond initiation which may be required in any given function of one of the controllers). And, it has employed an executive program which responds to real time interrupts to perform internal program functions and which responds to communication-initiated interrupts from other controllers in order to process serial communications with the other controllers, through the communication register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have never before been performed. The invention is not related to performing with microprocessors that which may have in the past been performed with traditional relay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Communication between the cab controllers 34, 35, and the car controllers 15, 16 in FIG. 1 is by means of the well known traveling cable in FIG. 1. However, because of the capability of the cab controllers and the car controllers to provide a serial data link between themselves, it is contemplated that serial, time division multiplexed communication, of the type which has been known in the art, will be used between the car and cab controllers. In such case, the serial communication between the cab controllers 33, 34, and the car controllers 15, 16 may be provided via the communication register unit function of the TMS-9900 microprocessor integrated circuit chip family, or equivalent. However, multiplexing to provide serial communications between the cab controller and the car controller could be provided in accordance with other teachings, known to the prior art, if desired. The controllers 15, 16, 17, may each be based on a microcomputer which may take any one of a number of well-known forms. For instance, they may be built up of selected integrated circuit chips offered by a variety of manufacturers in related series of integrated circuit chips, such as the Texas Instruments 9900 Family. Such a microcomputer may typically include a microprocessor (a central control and arithmetic and logic unit), such as a TMS 9900 with a TIM 9904 clock, random access memory, a read only memory, an interrupt priority and/or decode circuit, and control circuits, such as address/operation decodes and the like. The microcomputer is generally formed by assemblage of chips on a board, with suitable plated or other wiring so as to provide adequate address, data, and control busses, which interconnect the chips with a plurality of input/output (I/O) modules of a suitable variety. The nature of the I/O modules depends on the functions which they are to control. It also depends, in each case, on the types of interfacing circuitry which may be utilized outboard therefrom, in controlling or monitoring the elevator apparatus to which the I/O is connected. For instance, the I/Os which are connected to car call or hall call buttons and lamps and to switches and indicators may simply comprise buffered input and buffered output, multiplexer and demultiplexer, and voltage and/or power conversion and/or isolation so as to be able to sense cars hall or lobby panel button or switch closure and to drive lamps with a suitable power, whether the power is supplied by the I/O or externally.

An I/O module may provide serial communication over current loop lines 13, 14, 36, 37 between the car controllers 15, 16 and the cab controllers 34, 35 and the group controller 17. These communications include commands from the group controller to the cars such as higher and lower demand, stop commands, cancelling hall calls, preventing lobby dispatch, and other commands relating to features, such as express priority service when requested by a switch 38, 39. These communications also include information concerning car calls, normally requested by buttons in panels 40, 41 exchanged between cab and car controllers as well as the group controller. The group controller initiates communication with each of the car controllers in succession, and each communication operation includes receiving response from the car controllers, such as in the well known "handshake" fashion, including car status and operation information such as whether the car is in the group, is advancing up or down, its load status, its position, whether it is under a go command or is running, whether its door is fully opened or closed, and other conditions. And each car controller 15, 16 engages in similar communication with its own cab controller 34, 35. As described hereinbefore, the meanings of the signals which are not otherwise explained hereinafter, the functions of the signals which are not fully explained hereinafter, and the manner of transferring and utilizing the signals, which are not fully described hereinafter, are all within the skill of the elevator and signal processing arts, in the light of the teachings herein. Therefore, detailed description of any specific apparatus or mode of operation thereof to accomplish these ends is unnecessary and not included herein.

Overall program structure of each controller, based upon a data processing system, in which the present invention may be practiced, is reached through a program entry point as a consequence of power up causing the highest priority interrupt, in a usual fashion. Then a start routine is run in which all RAM memory is cleared, all group outputs are set to zero, and building parameters (which tailor the particular system to the building, and may include such things as floor rise and the like) are read and formatted as necessary, utilizing ordinary techniques. Then the program will advance into the repetitive portion thereof, which, in accordance with the embodiment described herein, may be run on the order of every 200 milliseconds. This portion of the program commences with an initialize routine in which all forcing (FORC) and all inhibit or cancel (INH) functions are cleared from memory; field adjustable variables are read and formatted as necessary; the status of each car is read and formatted as necessary; and all the hall calls and car calls are read, and corresponding button lights for sensed calls are lit. Then, all inputs obtained by communication between the cars, the cabs and the group are distributed to the various maps and other stored parameter locations relating thereto.

After initialization a variety of elevatoring functions are performed by various routines on various time bases. Such routines include assigning cars to answer hall calls, parking cars in zones, handling up peak and down peak traffic, and various other functions, including the emergency priority service described hereinafter with respect to the present invention. The car controllers 15, 16 may be implemented in a fashion similar to that described hereinbefore with respect to the group controller 17, having I/O devices suitable for communication with the cab controllers 33, 34 over lines 13, 14 and suitable for interacting with circuitry for controlling the sheave/motor/brake assemblies 7, 8 as well as any related transducers, such as the primary position transducers 25, 26. The car controller has a principal task of controlling the motion of the cab, and at times controlling the cab door. These functions necessarily include other, known subfunctions such as recognizing car calls, and responding to car calls or floor calls assigned by the group (or otherwise) in conjunction with the position of the cab to cause the cab to open and close its doors at appropriate times. Since these functions, and the communications between the various controllers to effect them, are, except as provided hereinafter with respect to the present invention, generally known and within the skill of the art, no particular aspect of them being involved herein except as provided hereinafter, further discussion thereof is not otherwise provided herein.

The motor/brake/sheave assemblies 7, 8 may have motor current provided by direct drive power supplies, which employ electronic components to control the motor, but more typically and traditionally employ motor generator sets, such as of the Ward-Leonard type. In order to conserve energy, it is desirable to not run the motor generator sets (referred to as MG, hereinafter) when these are not needed. However, it takes a lot of energy to accelerate and stabilize the MGs when they are first turned on; and, elevator performance can be diminished if MG start-up is required before the elevator can respond. The economics of energy conservation also require that an electric utility customer not exceed certain peak power limitations so as to avoid peak demand power rate penalties. Therefore, it is desirable to allow shutdown of MGs as much as possible, and but not unnecessarily, it is desirable to stagger the high-current start-up of MGs in an elevator group.

The control of shutdown and start-up of MG sets, in accordance with the present invention is a combined function of conditions existing in individual cars as well as in the group of cars. Therefore, control is shared by the car controllers 15, 16 and the group controller 17.

Figure 2:
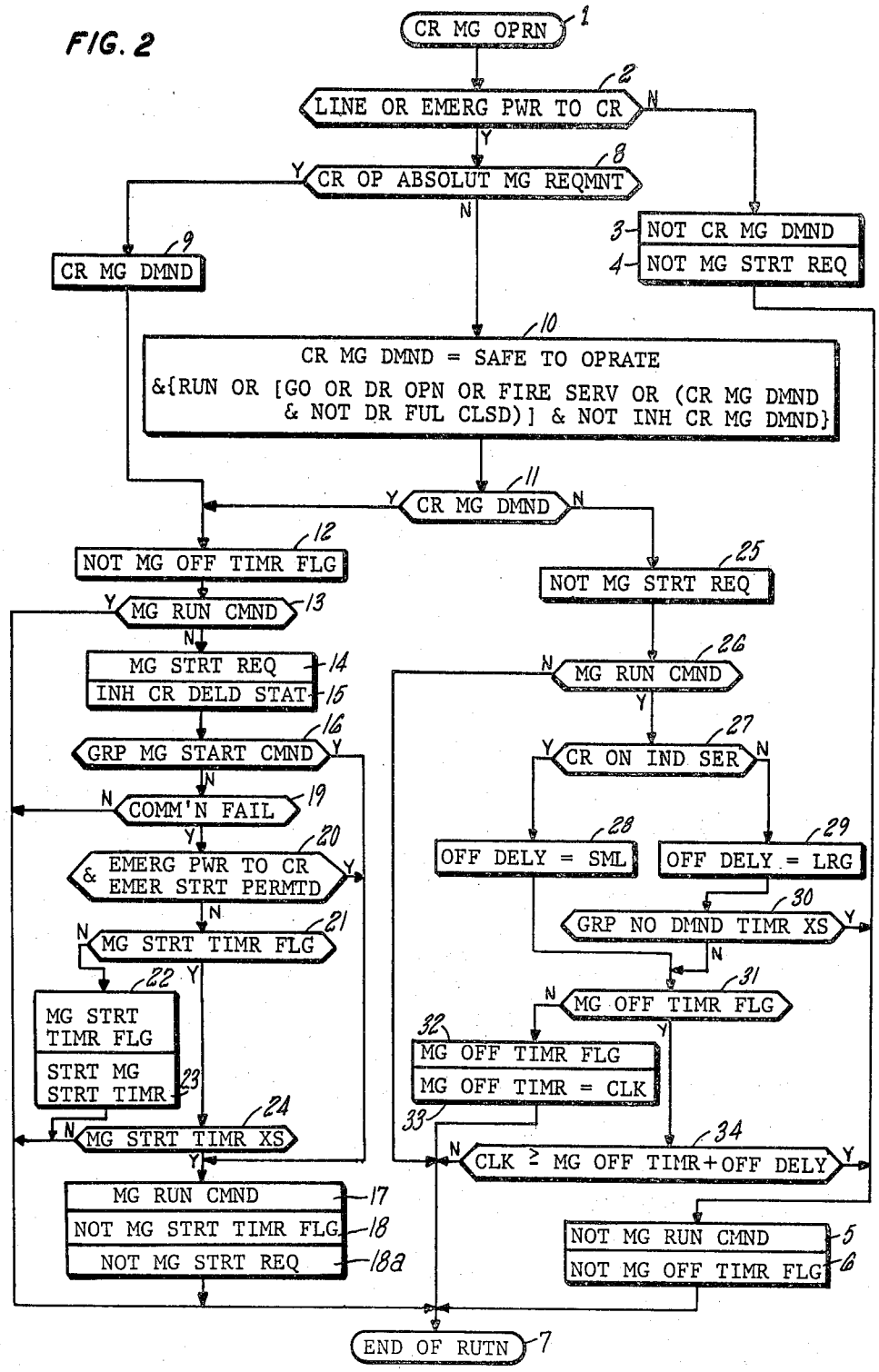
FIG. 2 is a simplified logic flow diagram of programs which may be run in a microprocessor of a car controller in a system of the type illustrated in FIG. 1 for providing car control over start-up and shutdown of its MG set, in conjunction with a group controller, in accordance with the present invention.

A program which may be performed in the microprocessor of the car controllers 15, 16 to control car MG operation in conjunction with the group controller 17 is reached in FIG. 2 through an entry point 1. A first test 2 determines if power, either line or emergency battery power, is available to the car. If it is not, the MG cannot be run, so steps 3 and 4 reset car MG demand and the MG start request for the particular car. And steps 5 and 6 reset MG run command and an MG OFF timer flag, for purposes described hereinafter. And the routine of FIG. 2 is ended and other parts of the program are reached by an end of routine point 7.

If power is being supplied to the car, an affirmative result of test 2 will reach a test 8 to see if the car operation control is such as to absolutely require MG operation. For instance, if the car is involved in a rescue operation (low speed operation to allow passengers to get out at the next floor, after an emergency stop), or if group demand is forcing the car to run, or if internal operations (such as establishing an initial position reference for the primary position transducer 25, 26) is being performed within the car, the car operation status will cause an affirmative result of test 8. This causes a step 9 to set a car MG demand flag. If step 8 is negative, MG demand may still be present. A step 10 will set car MG demand if a safe to operate flag indicates there is no safety inhibition thereto, and if a plurality of other conditions exist. One of these conditions is run status of the car; the other of these conditions is that there is no car operation logic inhibiting car MG demand and the status of the car includes either go, door open, fireman service, or the combination of a present car MG demand and the doors not fully closed. Thus, MG demand is maintained until there is no car demand (no go signal) and the car is parked with its doors fully closed. If suitable conditions exist, the car MG demand may be set in step 10. Then a test 11 determines if car MG demand has been set or not. Thus, in every major microprocessor cycle (such as on the order of each 200 milliseconds), if a car has power, car MG demand will be set when absolutely required in step 9, or in response to dispatching conditions in step 10. Thus the MG demand status is updated in each cycle.

As is obvious in FIG. 2, if car MG demand is set, the request for starting, or inability to start (all the start and run functions) are performed by portions of the routine shown to the left in FIG. 2; but if there is no MG demand, then interaction with the group controller 17 with respect to shutdown of the MG set (or leaving it shut down) are controlled by portions of the routine illustrated to the right in FIG. 2.

In FIG. 2 if there is car MG demand, an affirmative result of either test 8 or test 11 will reach a step 12 which resets a flag indicating whether or not an MG off timer (used during shutdown) has been set; this ensures that when start-up is attempted, the shutdown sequencing is reset, as described hereinafter.

A test 13 determines if an MG run command has previously been established; this is a command that actually causes start-up of the MG set, such as by pulling in a main MG power relay to commence acceleration of the MG set. If it has, the routine of FIG. 2 knows that its work has been done and the car MG demand will be satisfied by the MG run command already having been established. In such a case, the program simply reverts to other routines through the end of routine point 7. But if the MG run command has not been established, then sequencing and interaction with the group is required in order to establish the desired MG run command, in accordance with the invention. Therefore, a negative result of test 13 causes a step 14 to set an MG start request and a step 15 to inhibit or cancel delayed status of the car. In other words, during MG start-up the car does not consider whether or not it is in delayed status (e.g., car being held by doors being clocked open, even when there is further demand as in first use in the morning), when waiting for start-up to be completed, as described hereinafter. Thus, delay will not force the car out of the group.

In FIG. 2, a test 16 determines if the group has provided an MG start command to this particular car. If it has, an affirmative result of test 16 leads to a step 17 which sets the MG run command (the desired result). And, for those cases where step 17 is reached by car operation, rather than group operation, as described hereinafter, an MG start timer flag is reset in a step 18. Once the MG run command is set, the MG start request is reset the step 18*a*. Then the routine is ended in the usual way. Once step 17 has been reached, subsequent passes through the program, so long as there is car MG demand as determined by affirmative result of test 8 or test 11, will simply pass through the affirmative result of step 13 as described hereinbefore.

In FIG. 2, if the group has not issued an MG start command to this particular car, test 16 is negative and a test 17 determines if there is a communication failure between the car and the group. This test simply interrogates the status flags which are automatically set as a result of normal I/O communication routines between the group controller 17 and the appropriate car controller 15, 16. If the microprocessor in the related car controller 15, 16 determines that the communication protocol is not operating properly, the communication failure flags will result in test 17 being negative. Thus, if the group has not issued a start command, but there is no reason to suspect that it will not do so shortly in response to the request set in step 14, it is simply a question of waiting a few cycles, or waiting out the sequencing described hereinafter, before such command should be issued by the group. On the other hand, if test 17 indicates that the car controller and group controller are no longer properly communicating with each other, then, in accordance with the invention, the car determines whether or not it is capable of starting its own MG set. A first test 18 determines if this car is both receiving emergency power and is receiving a flag bit (such as may be set by a group directive, by lobby panel switches set by a dispatcher, or by service switches set by a maintenance man) to permit this car to run on emergency power (only one car at a time being permitted to run on emergency power, in the usual case). If test 20 is affirmative, step 17 is reached and the MG run command is set as described hereinbefore. But if test 20 is negative, then a test 21 interrogates a once-only MG start timer flag (the one which is reset in step 18 as described hereinbefore) to see if MG start-up has been initiated or not. If test 21 is negative, a step 22 sets the MG start timer flag to indicate that timing has begun and the MG start timer is reset in a step 23. The timer may be implemented by any suitable function capable of indicating when the time has elapsed (referred to herein as "XS"); for instance, it may be implemented by simply recording the indication of the real time clock at one point, and repetitively comparing the real time clock with the recorded value plus a desired time interval increment in each subsequent test, as is described with respect to other timers hereinafter. Once the timer is started and its flag set, the program reverts through the end of routine point 7. In subsequent passes through the routine of FIG. 2, test 21 will be affirmative and a test 24 will determine when the MG start timer excess has occurred. During the time-out, a negative result of test 24 causes ending of the routine; but when the time interval has passed, an affirmative result of test 24 will reach step 17 to set the MG run command and step 18 will reset the timer flag. Thus, the normal starting of the MG set is either because of a car MG demand causing the MG start request of step 14 to request an MG start command from the group controllers, or whenever the car and the group are not talking to each other, either when permitted on emergency power or after some time delay. If failure to communicate with the group is because the group (rather than this car) has failed, the usual system demands all cars return to the lobby to begin "wild car" or "bus" type service. Because the group may have failed and therefore be incapable of providing a staggered sequence of start requests to all of the cars, each of the car controllers 15, 16 in the group has a different MG start timer time interval (step 23, test 24) so that they will nonetheless start up their MG sets in a delayed fashion from each other, thereby avoiding high energy demand which could result from coincident start-up. The time intervals should differ, from car to car, by an amount of time approximating the time for an MG set to accelerate to nearly full speed. This is a principal feature of the present invention.

Figure 3:
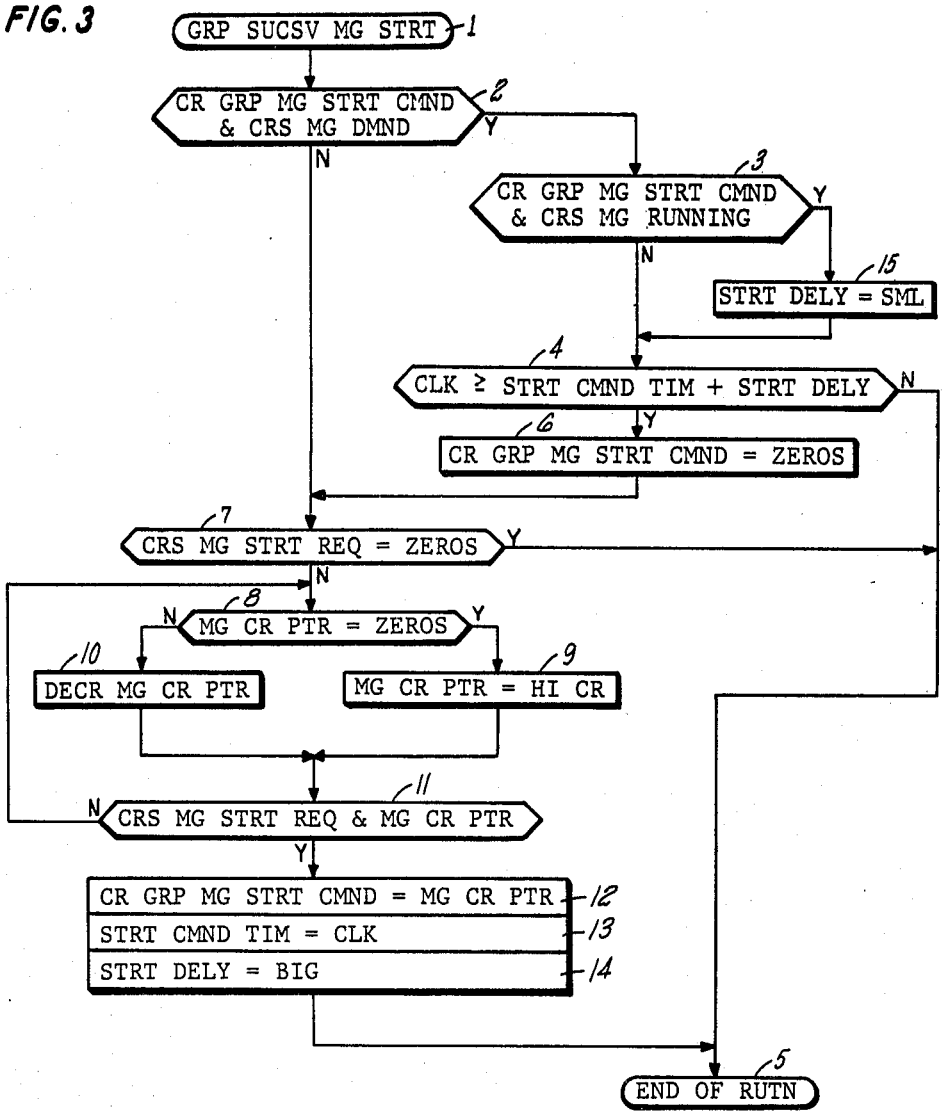
FIG. 3 is a simplified logic flow diagram of a program which may be run in a group controller of the type illustrated in the system of FIG. 1 for controlling the start-up of a plurality of elevator MG sets in accordance with the invention.

The start-up of each car's MG set involves an interplay between the car controllers 15, 16 (FIG. 1) and the group controller 17 as described hereinbefore. Within the group controller 17, a group successive MG start routine is illustrated in FIG. 3 and is reached through an entry point 1. A first test 2 determines if the group is issuing a start command to a car which has MG demand. This is accomplished by ANDing a car group MG start command pointer (only one car-related bit being permitted at a time in the pointer) with a map of cars which have MG demand. The map of cars which have MG demand, tested in test 2 of FIG. 3, contains bits corresponding to each car for which car MG demand is established in either step 9 or step 10 of FIG. 2 in the related car.

In FIG. 3, if the group is issuing a start command to a car which has MG demand, test 2 will be affirmative and reach a test 3 which determines if the group is issuing a start command to a car which already has its MG set running, as determined by ANDing the pointer of the car receiving the group MG start command with a map of cars having their MG running. The map of cars with MG running is a map having a bit for each car which has had the MG run command flag set in step 17 of FIG. 2 for the related car, and as a result, the MG set has accelerated to the point where running power in contrast with start-up power) is being supplied to the MG set. This may be sensed by monitoring what is typically referred to in some systems known to the art as an "M" relay. As is described hereinafter, when an MG start request is made by a car (step 14, FIG. 2) the request is communicated to the group controller 17 (FIG. 1) and is acted upon in the group controller by means of the routine of FIG. 3, it nonetheless takes time for this start command to be honored in view of the fact that the MG sets are only allowed to start one at a time when they are started by the group, and time is necessary for communications between the controllers, on a cyclic basis. Test 3 determines whether or not all of these functions have been performed. Initially, the usual result of test 3 upon issuing a car group MG start command will be negative. A negative result of test 3 reaches a test 4 in which a start command timer is interrogated. As described hereinafter, when a start command is issued, a register is set with the current value of a real time clock. Thereafter, test 4 determines whether the start delay has been exceeded by comparing the current clock value with the stored clock value added to the start delay increment. Normally, one pass through tests 2, 3 and 4 will result during the starting delay interval so that a negative result of test 4 will cause other parts of the program to be reverted to through an end of routine point 5. The "big" start delay is to sense a case where an MG set has not started in response to the group start command, so that the command can be canceled, and other MG sets may be started instead. After the start delay has expired, test 4 will be affirmative reaching a step 6 which sets all zeros in the car group MG start command pointer. This resets the most recent MG start command. Then a test 7 determines if there are any outstanding car MG start requests. This is done by determining whether or not a map of cars having outstanding start requests is all zeros. This map is made up of one bit for each car in the group, the bit being a ONE for all of those cars who have issued an MG start request in step 14 of FIG. 2. In FIG. 3, if there are no start requests, the result of test 7 will be affirmative and the program will revert to other routines through the end of routine point 5. Thus, when all MGs are running or no MGs are either running or do not desire to run, the normal passage through the routine of FIG. 3 is from a negative result of test 2 (there being no start commands issued to cars having MG demand) and a negative result of step 7 (there being no outstanding start requests).

If the result of test 7 is negative, that means there is at least one car requesting that its MG be started. This reaches a test 8 which determines whether all of the cars, from the highest numbered car to the lowest numbered car have been polled or not. If they have, the MG car pointer (a map of bits, one per car, only one being set at a time so as to point to a particular selected car) will be all zeros, so an affirmative result of test 8 will reach a step 9 which reestablishes the MG car pointer with a bit indicating the highest numbered car in the group. On the other hand, if step 8 is negative, the lowest numbered car has not yet been polled and a negative result of test 8 will reach a step 10 which simply decrements the MG car pointer to point to the next lower numbered car in the group. Then, a test 11 determines if the selected car has an outstanding MG start request by ANDing the map of cars having an MG start request (the same map as in test 7) with the MG car pointer. If not, a negative result of test 11 will reach tests and steps 8-9 so the next car in sequence can be tested. But if this car does have an outstanding request, an affirmative result of test 11 will reach a step 12 in which the car group MG start command pointer is set equal to the MG car pointer, the start command timer is initiated by setting the start command time equal to the real time of a clock in a step 13, and the start delay is set to a relatively bit delay, such as on the order of thirty seconds. This thirty seconds is to provide adequate time for the start command to be communicated (during those portions of the microprocessor programming of the group controller 17 devoted to communication operations) to the car controller 15, allow the car controller 15 to act on it and get its MG set running, communicating that fact back to the group, having the group recognize it and cancel the start request for that car; otherwise, the attempt is abandoned after time-out. During the time-out of the start command times, all other MG start requests are ignored because the outstanding start command causes test 2 to be affirmative, so test 7 cannot be reached until time out. This occurs in subsequent operations by test 2 being affirmative, reaching test 3. As described hereinbefore, when the start command has been issued to a car by the group, initial subsequent passes through the routine of FIG. 3 will be through the negative result of test 3, and testing the timer in test 4. If the car achieves a run command and this is communicated to the group prior to time-out of the big start delay (as set in step 30 and tested in test 4 of FIG. 3) then an affirmative result of test 3 will reach a step 15 in which the start delay is reset to a very small value so that subsequent passes through test 4 will be against a very small value which probably had already expired, such as on the order of one second. This will force an affirmative result of test 4 so that the start command can be reset in step 6. The relatively big start delay is long enough to ensure that the high energy demand portion of the MG's actual start-up and acceleration has ended, so that the next MG in turn can be started (if any is requesting start-up). The small delay (of step 15) ensures that there is at least one second delay (e.g., when a still-rotating MG set is restarted), to ensure nearly full speed operation after the "M" relay is closed.

The car MG operation routine of FIG. 2 is also operative in the shutdown of the MG set. As indicated before, if there is no power to the car then car MG demand and MG start request are not permitted by steps 3 and 4 (FIG. 2). In other cases as well as this case, this shutdown of the MG set is accomplished in the routine of FIG. 2 by resetting the MG run command in step 5.

In FIG. 2, if there is no MG demand, negative results of both tests 8 and 11 reach a step 25 which ensures that the MG start request is reset. Then a test 26 determines if the MG is running or not. If it is not, the program reverts through the end of routine point 7. This is the normal manner in which the routine of FIG. 2 is passed through when the car is quiescent, with the MG not running and no demand for it to run. On the other hand, if tests 8 and 11 are negative, indicating that there is no MG demand, but test 26 is affirmative indicating that the MG is still running, then the shutdown procedures are brought into play. An affirmative result from test 26 reaches a step 27 which determines if the car is on independent service or not. If it is, a step 28 causes an off delay value to be set to a small value, such as on the order of one minute. On the other hand, if the car is not on independent service, a negative result of test 27 reaches a step 29 where the off delay value is set to a relatively larger value, such as on the order of five minutes. And a test 30 determines if the group has indicated that its no demand timer has timed out or not. The steps and tests 27-30 are part of another feature of the present invention. This provides operation in which a car on independent service can shut itself down as soon as its motion demand ends, after a small delay to allow the necessary few cycles for the group to reacquire control over the car and provide it with demand (bearing in mind that the group could not have been providing demand to a car on independent service); if after the group has a chance to reacquire control over the car it does not desire to use the car, then the car MG is allowed to be shut down. On the other hand, if the car is in the group, there may continue to be general group demand or there may not. In a usual case, if there is no group demand whatsoever, none of the cars need to be run, and all of the MG sets may be shut down. Such might be the case in the middle of the night in an office building. On the other hand, there may be group activity, with only one or two of six or eight elevators being operated (the other elevators having no demand on them, such as may be the case in the evening in an office building). In such a case, prior art systems would retain all elevator MG sets running until there is no further group demand. But in accordance with the present invention, if it becomes apparent that group demand is being satisfied by other elevators, then the particular car in question can turn off its MG set after a period of time.

In FIG. 2 if the car is not on independent service, it is on group service. Thus a negative result of test 27 together with an affirmative result of test 30 indicates that the car is available to the group but the entire group has no demand and so the entire group is being shut down. Thus, step 5 will be reached and the MG run command for this car will be reset (along with the MG off timer flag). And the program can then revert to other routines through the end of routine point 7. On the other hand, if step 27 is affirmative, meaning that the car is independent of the group or if tests 27 and 30 are both negative, indicating that the car is assigned to the group and there still is group demand, a test 31 is reached to determine if the once-only MG off timer flag for this car has been set or not. If not, the flag is set in step 32 and the MG off timer register is set with the current value of a real time clock. In subsequent passes through the routine of FIG. 2, test 31 will be affirmative so that a test 34 is made to see if the MG timer has timed out or not. The time increment of this timer is determined by the delay value set in a selected one of step 28 or step 29. Thus if the car is on independent service, the time-out will occur after a smaller delay than if the car is on group service. In test 34 the current status of the real time clock is compared with the time recorded in step 33 added to the off delay time increment set in either step 28 or 29. During the time-out, step 34 is negative and the program reverts to other routines through the end of routine point 7. When this time has been exceeded, test 34 will be affirmative so step 5 will cause resetting of the MG run command so that the motor generator set can be shut down. And step 6 will cause resetting of the MG off timer flag so that should the program reach step 31 subsequently, the flag will not have remained in the set state.

The routine portion to the right in FIG. 2 therefore can shut off a car MG set when the car has no MG demand, either in response to the group (test 30 affirmative) or in response to its own off timer (test 34 affirmative) after a small delay (step 28) when it is on independent service, or after a somewhat longer delay (step 29) when it is on group service, but is not being shut down by the group. The car may become available to the group as a result of termination of independent service. It may therefore go from no demand to answering an emergency priority call to being on independent service while it services the call, to reverting to group service with no demand. In prior art systems, the MG set would have to continuously run even though the group had no demand for the car. Or, the car might come off independent service and be immediately pressed into service by the group in which case the delay of step 29 would hold the MG set running until the car MG demand could be reestablished by the group (group demand being one of the exemplary conditions which could cause an affirmative result of test 8, hereinbefore). Or, the car could be on group service and be the last car which is satisfying any demand for the group, in which case (as described hereinafter) the time-out following no group demand (affirmative result of test 30) could come in a relatively short time (usually less than one minute) and the MG set could therefore be turned off by the group sooner than it could be its own MG off timer (step 29 and test 34).

Figure 4:
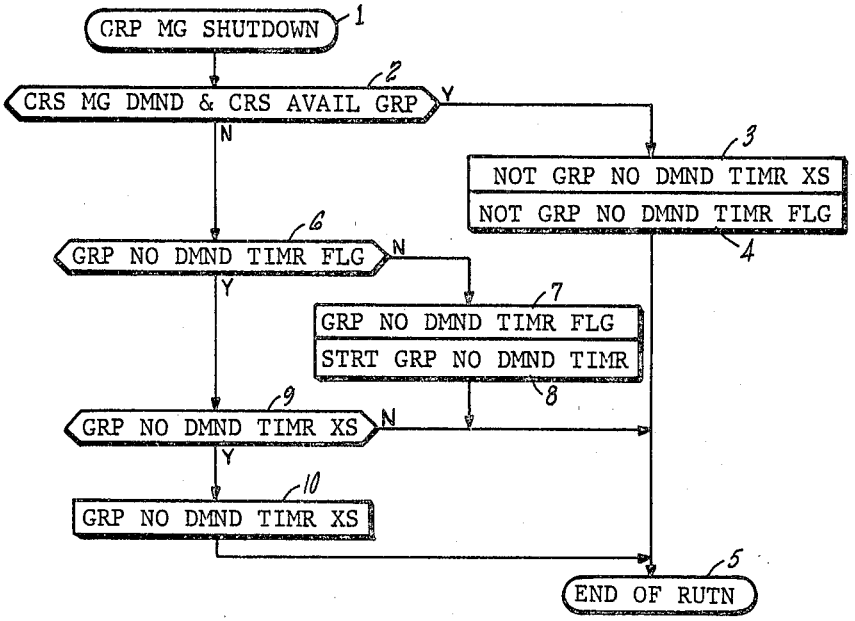
FIG. 4 is a simplified logic flowchart of a program which may be run in the group controller for controlling the shutdown of MG sets in accordance with the invention.

The group participation and the interplay between the group controller 17 (FIG. 1) and the car controllers 15, 16 in the shutting down of MG sets is accomplished by the group controller microprocessor in the group MG shutdown routine illustrated in FIG. 4 and reached through an entry point 1. A first test 2 determines if any of the cars available to satisfy group demand have indicated MG demand. This is done by ANDing a map of cars having MG demand, which includes one bit for each car that has had an affirmative result of tests 8 or 11 in FIG. 2, with the map of cars available to satisfy group demand. If test 2 is affirmative, step 3 ensures that there will be no indication to the cars that the group has had no demand for a stated period of time by resetting the group no demand timer excess indicator and step 4 will reset the group no demand timer flag (a once-only flag described hereinafter). And then other parts of the program are reverted to through an end of routine point 5. Thus, whenever any car serving the group has demand, the program of FIG. 4 just ensures that there will be no contrary indication, enables the timer by resetting the once-only flag, and then ends the routine.

In FIG. 4, when there is no car available to satisfy group demand that has a current car MG demand, the negative result of test 2 will reach a test 6 in which the group no demand timer flag is interrogated. This is a once-only flag that indicates that the timer has started. A negative result of test 6 (which will normally occur in the first pass through the routine of FIG. 4 after there are no more MG demands of the group cars) will reach a step 7 which sets the group no demand timer flag, indicating that the timer has started, and starts the group no demand timer in a step 8. Then the routine of FIG. 4 is complete. In a subsequent pass, step 7 having set the timer flag, test 6 will be affirmative so the status of the no demand timer is interrogated in a test 9. When the no demand timer has not timed out, test 9 will be negative and the routine of FIG. 4 is complete. Eventually, after no cars serving the group have had an MG demand for the duration of the no demand timer, test 9 will be affirmative and a step 10 will set the group no demand timer excess indicator which is utilized in test 30 of FIG. 2 to determine that group shutdown of all of the MG sets of cars in the group can occur. If, in a subsequent cycle, MG demand is created by one of the cars, then test 2 will again be affirmative, the group no demand timer excess indicator set in step 10 will be reset in step 3 and the group no demand timer flag set in step 7 will be reset in step 4, so that shutting down of any MG sets by the group could not occur, until all of the cars available to satisfy group demand have once again ceased to issue MG demands.

The first aspect of the present invention, MG start-up, is demonstrated in the left-hand of FIG. 2 along with FIG. 3; the second aspect of the invention, MG shutdown, is demonstrated in the right-hand of FIG. 2 in conjunction with FIG. 4.

The disclosure herein is illustrative of programs performable by microprocessors to achieve the features of the present invention. Obviously, various features thereof could be altered, or the same results could be achieved by commensurate, different program routines. Similarly, the present invention may be implemented utilizing dedicated digital or analog equipment connected to effect the operation of the invention in a fashion fully analogous or similar to that disclosed in the exemplary embodiments herein. Further, the invention may be implemented without each and every feature of the exemplary embodiments, if desired. These considerations are not paramount to the aspects of the invention, but rather, the provision of indepent, timed start-up of an elevator's MG set, with the timing being different for each elevator so as to avoid excessive start-up occurrence, commensurate with group control of MG start-up which similarly causes only one at a time to start up, is the pervasive characteristic of the first aspect of the invention. And, the ability of each elevator to shut its own MG set down, whether on group service or independent service, even though other elevators of the group are still running, is the pervasive characteristic of the second aspect of the invention.

Thus, although the invention has been shown and described with respect to exemplary embodiments thereof, it should be understood by those skilled in the art that the foregoing and various other changes, omissions and additions may be made therein and thereto, without departing from the spirit and the scope of the invention.

We claim:

1. An elevator system including a plurality of elevators movable in related shaftways having access to floor landings of a building for servicing the landings, each of said elevators comprising:

a car;

motion means, including a DC motor and a motor generator (MG) set for providing power to said motor, for moving said car to selected landings in response to demands for service; and signal processing means for providing an MG run command signal to said motion means for causing said motion means to run in response to demands for service;

characterized by:

said signal processing means comprising means responsive to demands for service for providing a car MG demand signal, for providing said MG run command signal to said motion means in response to said car MG demand signal, for providing, in response to the presence of said car MG demand signal concurrently with the absence of said MG run command signal, an MG start interval timer initiation signal, for providing an MG start timer excess signal after a predetermined time interval following the provision of said MG start interval timer initiation signal, and for providing said MG run command signal in response to said MG start timer excess signal, the predetermined time interval of the signal processing means of one of said elevators differing from that of another one of said elevators by a time increment related to the time required to accelerate said MG set from rest to approximately rated speed.

2. An elevator system according to claim 1 characterized by the predetermined time interval of each of said elevators differing from that of all other ones of said elevators by a time increment substantially equal to the time required to accelerate one of said MG sets from rest to rated speed.

3. An elevator system according to claim 1 characterized by means for providing a start signal to a selected one of said elevators indicative of the designation of said elevator as one which is to start on emergency power, each of said elevators comprising means to provide an emergency power signal indicative of said elevator being operated by emergency power, and each of said signal processing means comprising means for providing said MG run command signal in response to the presence of said MG demand signal, said start signal and said emergency power signal concurrently with the absence of said MG run command signal.

4. An elevator system including a plurality of elevators movable in related shaftways having access to floor landings of a building for servicing the landings, comprising:

a group controller interconnected for signal communication with each of said elevators and comprising means for providing MG start command signals to any one of said elevators in response to receiving an MG start request from the corresponding elevator; each of said elevators including:

a car;

motion means, including a DC motor and a motor-generator (MG) set for providing power to said motor, for moving said car to selected landings in response to demands for service; and signal processing means for providing an MG run command signal to said motion means for causing said MG set to run in response to demands for service;

characterized by:

said signal processing means comprising means for providing a car MG demand signal in response to demands for service, for providing said MG run command signal to said motion means in response to said car MG demand signal, for providing an MG start request signal to said group controller in response to the presence of said car MG demand signal concurrently with the absence of said MG run command signal, for providing said MG run command signal in response to one of said MG start command signals received thereby from said group, for providing a communication failure signal indicative of failure of signal communication with said group determined by said signal processing means, and for providing said MG run command signal in response to presence of said car MG demand signal and said communication failure signal concurrently with the absence of said MG run command signal and said MG start command signal.

5. An elevator system according to claim 4 characterized by means for providing a start signal to a selected one of said elevators indicative of the designation of said elevator as one which is to start on emergency power, each of said elevators comprising means to provide an emergency power signal indicative of said elevator being operated by emergency power, and each of said signal processing means comprising means for providing said MG run command signal in response to the presence of said MG demand signal, said start signal and said emergency power signal concurrently with the absence of said MG run command signal.

6. An elevator system according to claim 5 characterized by said signal processing means comprising means responsive to the presence of said car MG demand signal concurrently with the absence of said MG run command signal, said MG start command signal, said communication signal and either said start signal or said emergency power signal for providing an MG start interval timer initiation signal, for providing an MG start timer excess signal after a predetermined time interval following the provision of said MG start interval timer initiation signal, and for providing said MG run command signal in response to said MG start timer excess signal, the predetermined time interval of the signal processing means of one of said elevators differing from that of another one of said elevators by a time increment related to the time required to accelerate said MG set from rest to substantially rated speed.

7. An elevator system according to claim 4 characterized by each of said signal processing means comprising means for providing said car MG demand signal to said group controller, and said group controller comprising means responsive to the presence of either a car MG demand signal provided by one of said elevators or a start MG command signal provided to said one elevator without concurrent presence of the other one of said signals, concurrently with the presence of any one of said MG start request signals, for providing a start command signal to one of said elevators, for providing a time signal indicative of the time in which said MG start command signal was provided, for providing a signal indicative of a time interval having elapsed since the time indicated by said time signal, and for eliminating said MG start command signal in response to said signal indicative of time lapse.

8. An elevator system including a plurality of elevators movable in related shaftways having access to floor landings of a building for servicing the landings, comprising:

a group controller interconnected for signal communication with each of said elevators; and each of said elevators comprising:

a car; and motion means, including a DC motor and a motor-generator (MG) set for providing power to said motor, for moving said car to selected landings in response to demands for service; and signal processing means for providing an MG run command signal to said motion means in response to demands for service;

characterized by:

said signal processing means comprising means to provide a car MG demand signal in response to demands for service, for providing said MG run command signal in response to said car MG demand signal, for providing said car MG demand signal to said group controller, and said group controller comprising means responsive to the absence of any of said car MG demand signals for providing a first signal indicative of the start of a group no demand time interval and for providing to each of said cars a group no demand timer excess signal after a group no demand interval of time following the provision of said first signal, and said signal processing means comprising means responsive to said group no demand timer excess signal to cease providing said MG run command signal to said motion means.

9. An elevator system according to claim 8 characterized by said signal processing means comprising means for providing a second signal indicative of the concurrent absence of said car MG demand signal and said group no demand timer excess signal and for providing an MG off timer excess signal after an MG off timer delay interval of time following the provision of said second signal, said MG off timer delay interval exceeding said group no demand interval, and responsive to either said group no demand timer excess signal or said MG off timer excess signal to cease providing said MG run command signal to said motion means.

10. An elevator system according to claim 9 characterized by said signal processing means comprising means for providing an independent service signal indicative of the related elevator operating independently of said group controller, and for providing said MG off timer excess signal after an MG off timer delay interval which is of a lesser duration in response to said independent service signal than it is in response to the absence of said independent service signal.

* * * * *